United States Patent [19]

Wald et al.

[11] 4,288,476

[45] Sep. 8, 1981

[54] ONE SIDE COATING OF CONTINUOUS STRAND

[75] Inventors: Herbert Wald, Baltimore; Harold K. Young, Dundalk; Lacy C. Meadows, Baltimore, all of Md.

[73] Assignee: Bethlehem Steel Corporation, Bethlehem, Pa.

[21] Appl. No.: 148,655

[22] Filed: May 12, 1980

Related U.S. Application Data

[62] Division of Ser. No. 12,927, Feb. 16, 1979, Pat. No. 4,207,831.

[51] Int. Cl.[3] ..... B05D 3/04

[52] U.S. Cl. ..... 427/300; 427/329; 427/349; 427/434.4

[58] Field of Search ..... 118/58, 62, 63, 419; 427/329, 348, 349, 434.4, 300; 228/37, 39

[56] References Cited

U.S. PATENT DOCUMENTS

| | | | |
|---|---|---|---|
| 3,193,406 | 7/1965 | Mittelman | 118/58 X |
| 4,103,644 | 8/1978 | Michels | 118/63 X |
| 4,114,563 | 9/1978 | Schnedler et al. | 118/63 |
| 4,152,471 | 5/1979 | Schnedler et al. | 427/329 X |
| 4,178,397 | 12/1979 | Lovis | 118/62 X |

FOREIGN PATENT DOCUMENTS

| | | | |
|---|---|---|---|
| 2656524 | 6/1978 | Fed. Rep. of Germany | 427/300 |

*Primary Examiner*—Evan K. Lawrence

*Attorney, Agent, or Firm*—Joseph J. O'Keefe; William B. Noll

[57] ABSTRACT

Improved method for the continuous coating of one side only of a metal strip with molten coating metal, more particularly, one side galvanizing of a ferrous metal strip. The method includes moving a metal strip, supported by a deflector roll having a width less than that of the strip, in an arcuate path through a bath of molten coating metal with the side of the strip to be uncoated contacting the deflector roll. To prevent coating of the strip, a stream of gas is directed toward the edges of the side of the strip contacting the roll which project beyond the roll and against the surface of the bath.

6 Claims, 6 Drawing Figures

ONE SIDE COATING OF CONTINUOUS STRAND

RELATED APPLICATION

This is a division of application Ser. No. 12,927, filed Feb. 16, 1979, now U.S. Pat. No. 4,207,831, issued June 17, 1980.

BACKGROUND OF THE INVENTION

A. Why One Side Coating?

This invention is directed to a method for the continuous production of one-side coating of a metallic strand. More particularly, though not limiting in its application, the preferred invention is directed to one-side galvanizing of a ferrous base strip.

Armed with the knowledge of years of experience on the manufacture and use of two-side metallic coated steels, such as galvanized, aluminized, and several proprietary aluminum-zinc coatings, and recent and costly attempts to produce a suitable metallic coating on only one side of a ferrous strand, one may logically ask why sacrifice corrosion protection of one side, especially at a premium cost? The answer is simple—one must respond and be prepared to meet the demands of the consumer/-customer. Specifically the automotive industry, spurred by the public for more corrosion resistant car bodies, demanded it. The automakers wanted steels for auto bodies that could offer corrosion resistance to the underside while providing the outside with a suitable surface having the uniformity and paintability of cold-rolled steel strip. It has long been recognized that even special treated galvanized (two-side coating) did not offer a suitable surface for painting. Hence, the answer was one-side galvanized steel strip. Though the answer was simple, the means to achieve the end were not.

Inasmuch as the preferred invention herein deals with continuous hot-dip galvanizing, or at least certain aspects thereof, it may be helpful to review some general characteristics of a galvanizing process.

B. General Characteristics of Hot-dip Galvanizing

One of the first commercial practices still followed today is taught in U.S. Pat. No. 2,110,893, to Sendzimir. Sendzimir discloses a continuous galvanizing method whereby a ferrous strand, such as steel strip, is passed through a high temperature oxidizing furnace to produce a thin film of oxide coating on the steel strip. The strip is then passed through a second furnace containing a reducing atmosphere which causes a reduction of the oxide coating on the surface of the steel strip and the formation of a tightly adherent impurity-free iron layer on the steel strip. While the strip remains in such reducing atmosphere, the steel strip is immediately immersed in a molten zinc bath maintained at a temperature of about 850° F. (456° C.). The strip is then cooled in air, or by accelerated means, resulting in a bright spangled surface.

There is a modified gas cleaning process that is practiced today for the production of galvanized steel. Such a process uses a Selas-type direct-fired furnace and avoids the initial high temperature oxidizing treatment of the Sendzimir process.

A third practice which has also gained acceptance for galvanizing steel strip is described in U.S. Pat. Nos. 2,824,020 to Cook et al, and in 2,940,870 to Baldwin. The practice described by such patents includes the step of applying a flux to the strip to be galvanized. The flux acts as a cleaning agent producing an oxide-free strip surface, which readily coats with the molten zinc bath.

From each of such processes there is produced a galvanized coating which is ductile. However, such coating has a major drawback in that its spangled surface is too rough to permit a smooth paint finish. Further, when painting is desired costly surface preparation is generally required.

C. Galvanizing Modifications

To produce a non-spangled surface more adaptable to painting, without further treatment of the surface, a high temperature post heat treatment was introduced for the coated strip. This process is known as galvannealing.

The preparatory steps and the coating step are identical to the spangled or unalloyed version. After thee coating immersion step the coated strips follow different processing sequences. In U.S. Pat. No. 3,322,558 to Turner, a process is taught wherein the coated strip, as it leaves the galvanizing bath, is passed upwardly between rows of open burners. These burners are mounted in such a way as to minimize the effect of emissivity of the sheet and maximize heating of the strip by convection heat. This uniform heating of the strip at temperatures from 900° F. to 1200° F. (483° to 649° C.) results in a uniform dull finish where the coating surface is fully alloyed.

In the above galvannealing process, the zinc coated strip is heated to above the melting temperature of zinc, i.e. about 790° F. (421° C.), to accelerate the reaction of zinc with the coating base iron. This results in the growth of the intermetallic layer from the iron base to the surface. Thus, a characteristic of galvannealed strip is a fully alloyed coating and the absence of spangles. While the introduction of such galvannealing treatment appeared to provide an answer to improvements in the paintability of galvanized steel, a loss in coating ductility was found.

To overcome the inherent problems with unalloyed and fully alloyed galvanized strip, while retaining the desirable properties thereof, an intermediate product was developed. Such product, characterized as a partially alloyed galvanized coating in U.S. Pat. No. 4,059,711, is achieved by a method which carefully controls the alloying activity of zinc with the ferrous base in a continuous galvanizing operation.

D. Attempts at One-Side Coating

Metal coating practices to coat one side only of a continuous strip in a hot-dip coating operation have been known for many years. However, none have led to a large scale commercial practice. An early attempt is disclosed in U.S. Pat. No. 1,252,363, to Roberts. Such patent discloses apparatus and a method for coating tin on one side of a moving strip. In the process the strip is guided through a molten bath of tin where clamping collars along the strip edges prevent the molten tin from flowing over the strip edges. Such collars effect a fluid-tight joint at the strip edges below the surface of the bath.

Later developments approached the coating on one-side only of a continuous strip in a different manner. Such developments were characterized by the step of treating the scheduled uncoated side in such a manner that such side would not be wetted by the molten coating metal. U.S. Pat. No. 3,383,250, to Pierson et al, accomplished this by treating the surface to be free of coating metal with an air blast or oxygen, thereby producing on such side an oxide layer. A variety of further attempts, U.S. Pat. No. 3,149,987 to Crandall being exemplary of such attempts, treated the surface to be free of coating metal with a masking agent, such as sodium bentonite.

A very recent attempt to coat only one side of a moving strip is the meniscus process taught in U.S. Pat. No. 4,082,868, to Schnedler, et al. In the Schnedler process the strip surface to be coated is caused to travel sufficiently close to the molten coating metal bath surface that the surface tension and wetting characteristics of the coating metal will permit the formation of a meniscus which will continuously contact and coat the one side of the traveling strip.

The present invention, to be described hereinafter, avoids the mechanical clamps of Roberts, the surface protection and removal thereof of the masking practices, and the delicate controls of the meniscus process.

SUMMARY OF THE INVENTION

This invention is directed to a method for the continuous coating of one side only of a metal strand or strip with molten coating metal. More particularly, said invention relates to one side galvanizing of a ferrous metal strip.

The apparatus for carrying out the method of the invvention is characterized by (1) an atmosphere controlled entry chute through which said metal strip passes into the molten coating metal, (2) a deflector roll which guides said strip into and out of said molten coating metal, where the width of said deflector roll is less than the width of said strip, (3) movable guide means adapted to shift laterally with corresponding movement of said strip, and (4) gas jets secured to said guide means and directed towards the edges of the uncoated surface of said strip to prevent molten metal from contacting said uncoated surface.

In the practice of said invention the metal strip, maintained in a protective non-oxidizing atmosphere in said entry chute, is conducted into the molten coating metal about the deflector roll. The deflector roll, at an elevation about ¼" below the surface of the molten coating metal, directs said strip into and out of said molten coating metal. During the period of strip immersion in the molten coating metal the gas jets act directly against the strip edges thereby preventing coating of the upper surface of said strip.

DETAILED DESCRIPTION OF PREFERRED EMBODIMENT

In the description of the preferred method of this invention insofar as strip preparation of the strip to be coated is concerned, it will suffice to say that conventional strip preparation practices are followed. Such practices do not constitute a limitation on the present invention so long as when the strip enters the molten coating bath the strip surface to be coated is clean and oxide free, and the strip temperature is compatible with the coating practice followed. Suitable strip preparation practices have been discussed above.

Figure 1:
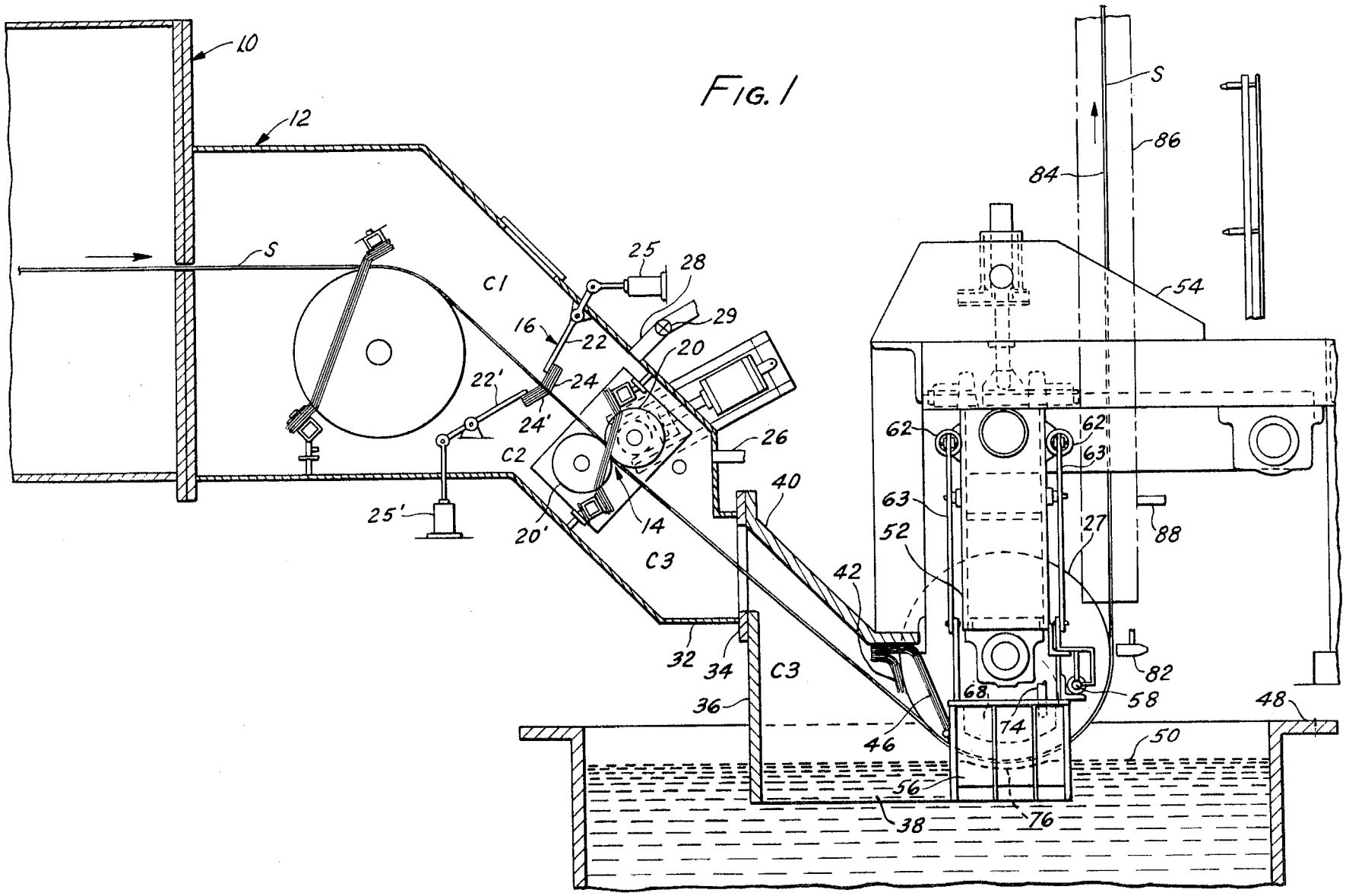
FIG. 1 is a longitudinal vertical section through a portion of a continuous strip not-dip coating line embodying the invention.

In the practice of this invention as shown in FIG. 1, strip S, typically low-carbon steel strip, exits the strip preparation apparatus 10 where it enters the entry snout 12, the strip S at this point possessing a clean and oxide free surface.

The entry snout 12, an extension of the strip preparation apparatus 10, is characterized by a plurality of gas pressurized chambers C1, C2 and C3. Separating adjacent pressurized chambers are gas-tight seals 14 and 16. Seal 16 is used under emergency conditions, such as during a line stoppage where there is a need to protect the idle strip still in the strip preparation apparatus 10. The seals employed in the apparatus of this invention, the purpose of which will be described hereinafter, may assume a variety of forms well known in the art. For example, such seals may comprise a pair of rolls 20, 20', a pair of pivotal members 22, 22'having an essentially gas impervious tip 24, 24' contiguous with the strip S, such as the one illustrated as separating chamber C1 from chamber C2.

It will be recalled that a major function of apparatus 10 is to prepare the strip S for coating by providing thereon a clean and oxide free surface. The entry snout 12, while serving to direct the strip S into the molten coating base, must also maintain the cleanliness of the strip surface to insure wetting by the coating metal on the surface to be coated. To achieve the desired result dry, inert gas, such as nitrogen is introduced into chamber via inlet 26. By maintaining a gas pressure differential (higher in C3) between chamber C1 and C3, at least a portion of the nitrogen gas introduced through inlet 26 will flow against the direction of the strip movement, mix somewhat with the reducing gas is chamber C1, preferably 13% NH, but not to a degree which would diminish the reducing quality of said gas. This positive pressure of inert (nitrogen) gas in chamber C3 insures that no oxygen enters chamber C1 provided the seal between the molten coating metal, the strip to be coated and the sidewalls and face of deflector roll 27 is not broken (through loss of liquid metal level for example). Should such seal-loss occur safety provisions have been made to prevent oxygen from infiltrating into chamber C1 where the gas is combustible. A 13% NH reducing gas is, for example, combustible. Inlet 28, provided for such an occurrence, is equipped with automatically opening valve 29, through which nitrogen gas can be introduced into chamber C2 whenever pressure in chamber C3 drops to near atmospheric. Simultaneous to the introduction of nitrogen, gas chamber C2 has to be formed by moving strip seals 24 and 24' against strip S by automatic actuation of pneumatic operators 25 and 25' respectively. The flow of nitrogen gas entering chamber C2 will be sufficient to create pressure within chamber C2 greater than that in strip preparation chamber C1, causing a slight inflow of nitrogen gas from chamber C2 into chamber C1. At the same time nitrogen gas is also out-flowing into atmosphere through seal rolls 20 and 20' thereby preventing oxygen infiltration into chamber C2 and consequently C1.

The forward end 32 of the entry snout 12 is characterized by flanged face 34 having secured thereto an extension of chamber C3. Said chamber is provided with rear wall 36 and side walls 38 which are submerged within the molten coating bath. To maintain reducing conditions with chamber C3, the upper wall 40 has secured at one end thereof a seal strip 42 which lies against the face of deflector roll 27. Seal strip 42, though not limiting, may comprise a refractory-like fabric, known commercially as Refrasil. To complete the sealing arrangement for chamber C3, seal strips 46 are provided to lie against the side of deflector roll 27.

Strip S, whose surfaces are clean and oxide free, passes in succession through chambers C1, C2, C3 into a coating pot 48 containing a bath of molten coating metal 50, such as zinc, aluminum, aluminum-zinc, etc. The strip is submerged within said bath 50 by the rotation of deflector roll 27, then emerges along a vertical path for solidification of the coating. The depth of strip immersion in bath 50 is about one-quarter inch (0.64 cm).

The deflector roll 27 is journaled for rotation in vertical supports 52 of housing 54 (FIGS. 2–5). On each support 52 there is mounted a slidable edge shield 56 which is adapted to move laterally with corresponding lateral movements of strip S.

It will be understood that in a given hot-dip coating operation, such as the present invention, the width of the strip to be coated is constant for any given coil as is the gauge thereof. Thus, while strip width is constant, the strip may nevertheless shift or move laterally as it traverses the coating line. As a consequence, edge shields 56, one on each side of deflector roll 27, must adjust so as to be essentially adjacent each strip edge. The lateral movements of the two edge shields 56 must therefore be coordinated.

Edge shields 56 are mounted for easy lateral movement on rails 58. The edge shield moves in response to the shifting strip. The edge shield 56 is held against the edge of strip S by pneumatic cylinders 62, acting through pivot arm 63, where the pneumatic force is sufficient to keep edge shield 56 in contact with said strip S at all times. Thus, at all times during the coating operation the slidable edge shields are essentially adjacent an edge of the strip. Application of compressed air to the opposite or reverse side of pneumatic cylinder 62 effects quick withdrawal of edge shield to accommodate a new, wider strip.

A characteristic feature of this invention is that the width (measured axially) of the deflector roll 27 is less than the width of strip S. For a deflector roll having a width of 34 inches (86.4 cm), the strip may vary between 38 and 46 inches (97 and 117 cm).

Figure 3:
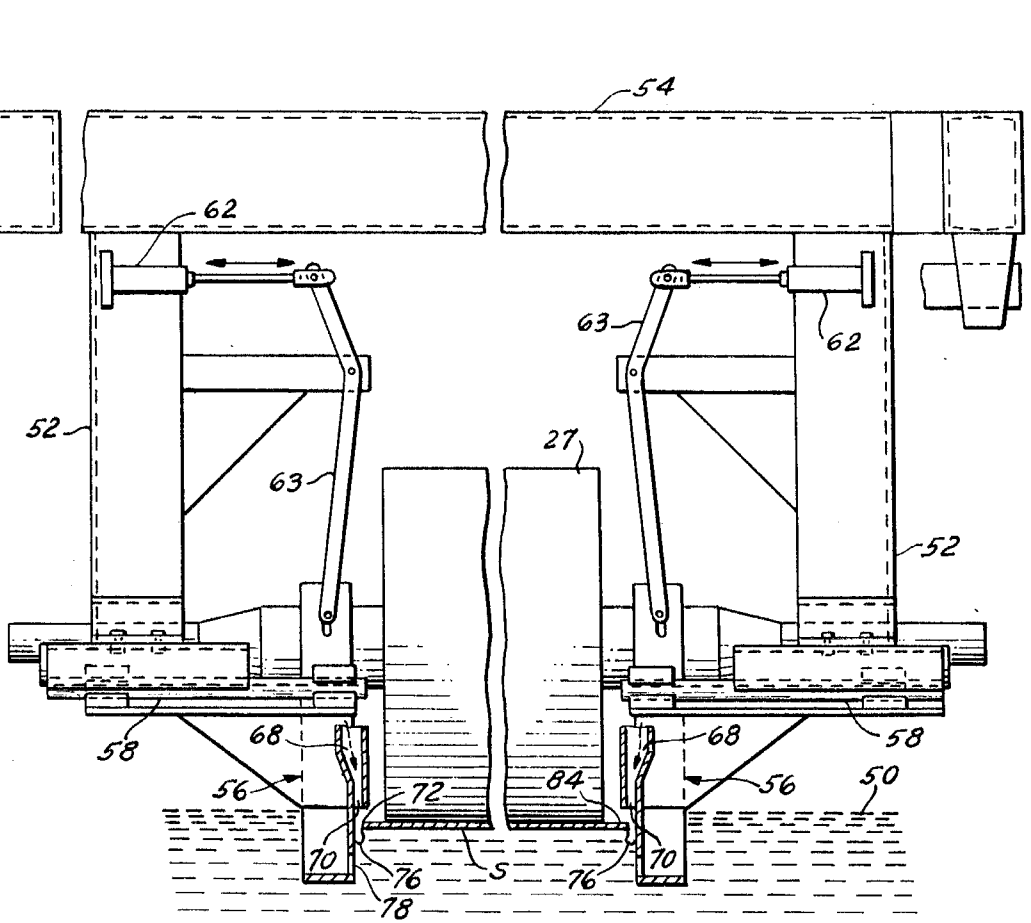
FIG. 3 is a front elevation, with parts in section, of the strip deflector roll and supporting mechanism shown in FIG. 2.
Figure 5:
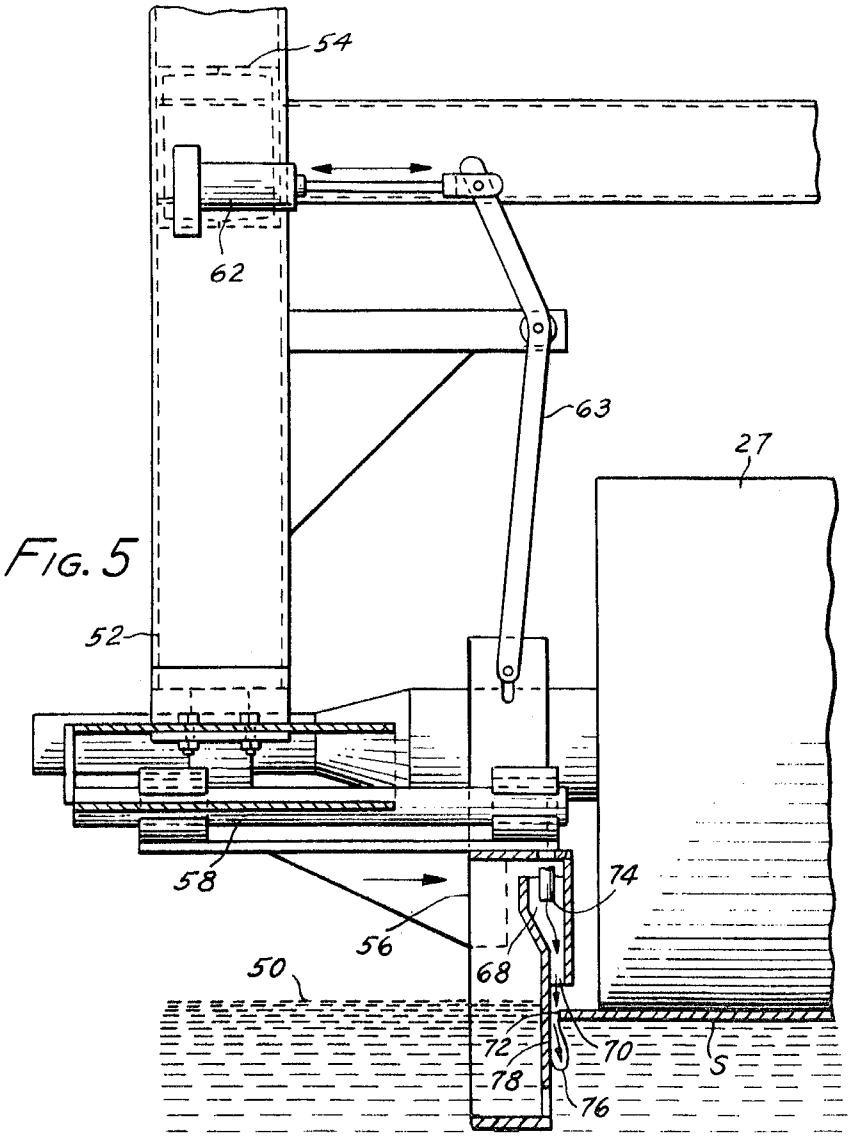
FIG. 5 is a front sectional view taken along 5—5 of FIG. 4.
Figure 4:
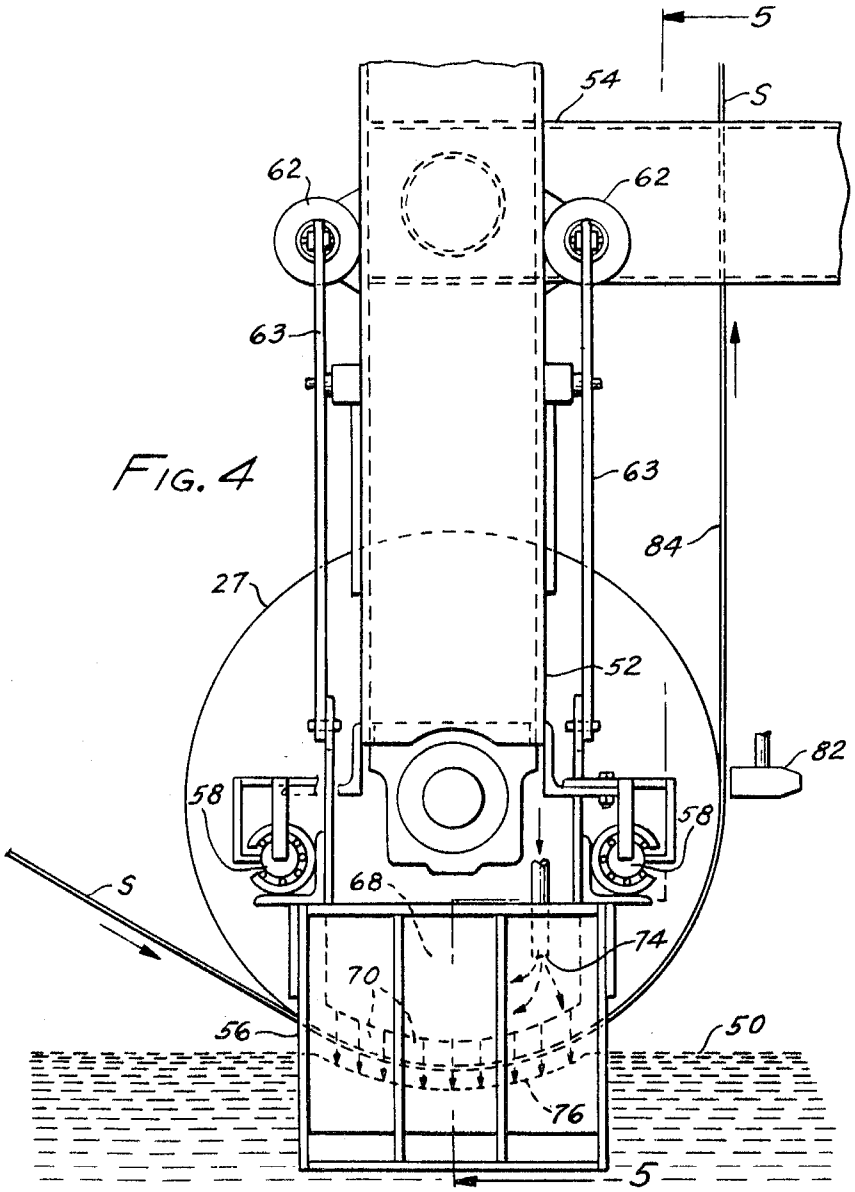
FIG. 4 is side elevation similar to FIG. 2, but illustrating additional details of the invention.

Referring in particular to the apparatus of FIGS. 3 and 5, it will be noted that each edge shield 56 has been provided with a chamber 68 having openings 70 thereto which are directed toward the strip edges 72 projecting beyond the deflector roll 27. A non-oxidizing gas, such as nitrogen, under pressure is transmitted through openingg 74 into chamber 68 to exit by way of openings 70. As best seen in FIG. 5, such gas is directed against the strip edge 72, while the strip is immersed in the molten bath, causing a depression 76 in said molten bath. Such gas, coupled with the damming action of wall 78, effectively prevents any molten coating metal from coating or even contacting the upper surface of strip S.

Figure 2:
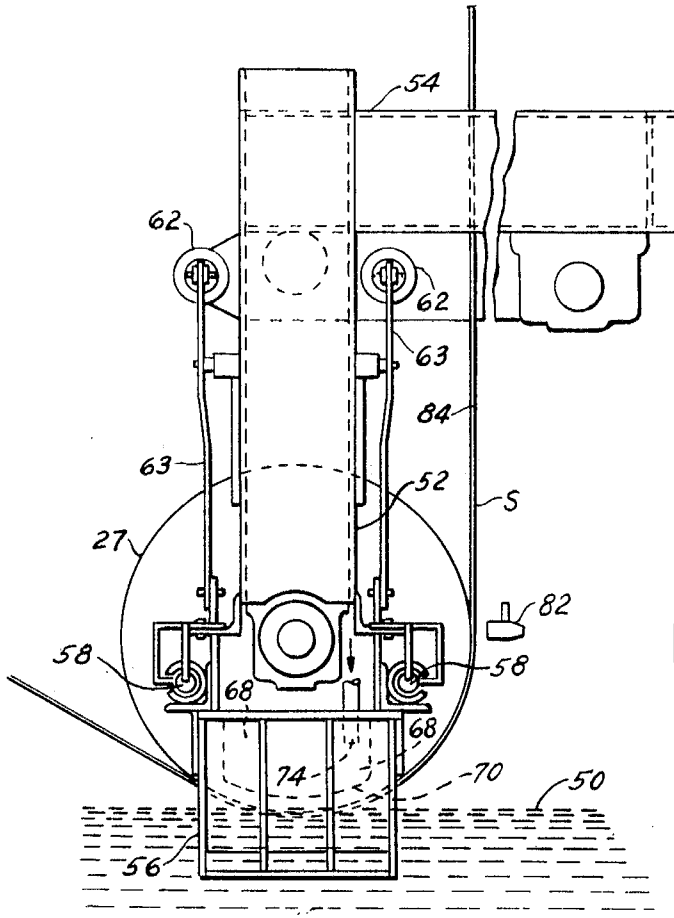
FIG. 2 is an enlarged side elevation of the strip deflector roll and supporting mechanism.

The bottom 70 of chamber 68 is curved to correspond with the path of strip S as it moves through bath 50, as shown in FIG. 2. This arrangement insures a uniform action of the gas jet against the strip edges and the molten coating metal. As an alternative to discrete openings shown in FIG. 4, the gas from chamber 68 may exit through a continuous slot whose width may be uniform or varying as desired.

As strip S emerges from bath 50, having a molten coating on the bottom side thereof, the strip remains in contact with deflector roll 27 then moves off on a tangent. While the strip is still supported by deflector roll 27 it passes adjacent a coating die 82 which directs air or steam or nitrogen gas against the molten coating. The coating die, known per se for coating weight control in hot-dip coating operations, is particularly effective herein as the fluid from coating die 82 is directed at the coated strip at a location where the strip is fully supported by the deflector roll 27, producing, because of the bend of the strip, an essentially flat surface. Such support is not possible in conventional two-side hot-dip coating. Without such support, the strip may tend to flutter, or a camber may have developed therein, which affects the uniformity of the wiping action of the air or steam. As a result of this technique, coating weights of great uniformity from edge to edge are a reality.

To minimize oxidation of the uncoated or top surface 84, the strip, after passing adjacent coating die 82, enters the non-oxidizing atmosphere of cooling chamber 86, shown in FIG. 1. Cooling gas, such as nitrogen, enters chamber 86 through inlet 88 where it exits down stream after suitably cooling the strip.

Figure 6:
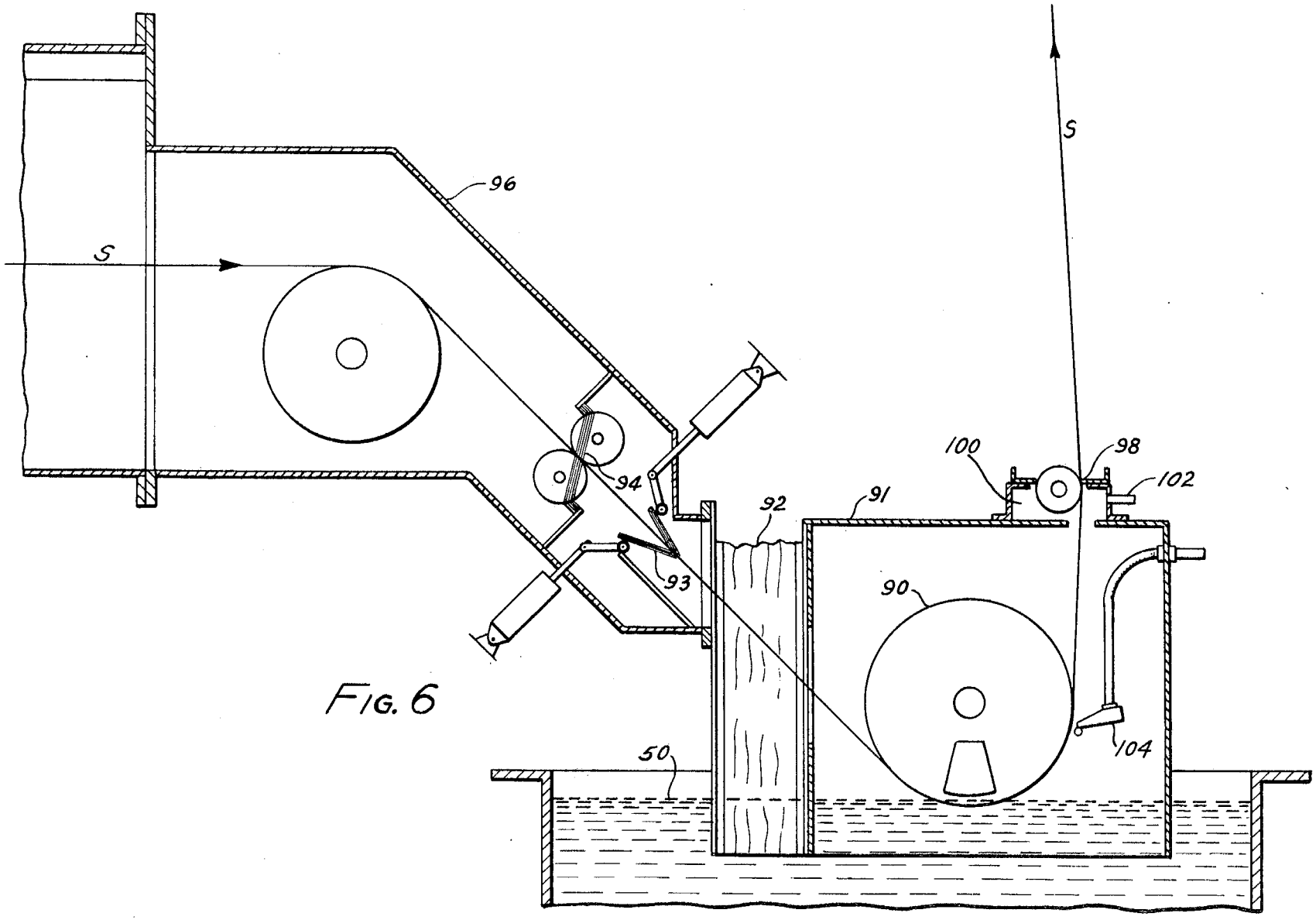
FIG. 6 is a side elevational view of a second embodiment of the coating apparatus of the invention.

FIG. 6 is a simplified illustration of an alternative embodiment wherein the coating apparatus, particularly the deflector roll 90 and supporting structure (not shown), are wholly maintained within a chamber 91 having a protective, non-oxidizing atmosphere. For convenience, chamber 91 may be connected to the rigid snout 96 by means of bellows 92.

It is still essential to use gas seals 93 and 94 in the entry snout 96 even though there is less chance of air infiltration into said snout 96. To minimize air or oxygen infiltration through exit portal 98, the exit chamber 100 is maintained under a high positive pressure of a non-oxidizing gas, such as nitrogen, introduced through inlet 102. Obviously, exit chamber 100 may be extended along the direction of strip movement to insure greater strip cooling capacity, and to minimize or prevent oxidation of the uncoated strip surface.

Coating weight is controlled similar to the description above, i.e. by means of a coating die 104. For this alternative embodiment, nitrogen gas, instead of air or steam, has to be used since the entire coating chamber must be inert gas filled. The molten coating metal in this embodiment has the distinct advantage of being without an oxide layer on the uncoated strip surface, while producing a superior metallic coating on the other strip surface.

Having thus described the invention in its most preferred embodiments, no limitation is intended to be imposed herein except as set forth in the appended claims.

We claim:

1. The method of coating a metallic strip with a molten coating metal on one side only, the second side of said strip being free of said coating metal, said process comprising the steps of cleaning said strip such that at least said one side to be coated is free of oxides and is wettable by said molten coating metal, providing a container for said molten coating metal, maintaining a bath of molten coating metal at a predetermined level within said container, moving said strip through said bath below said predetermined level, said strip following an arcuate path through said bath and supported therein by means of a deflector roll in contact with said second side of said strip and having a width less than the width of said strip, and preventing the coating of said second side of said metallic strip by said molten coating metal by directing a stream of gas toward the strip edges of said second side projecting beyond said deflector roll and against the surface of said bath of molten coating metal as said metallic strip moves through said bath.

2. The method according to claim 1 wherein said metallic strip is maintained in a non-oxidizing atmosphere while said metallic strip passes through said bath.

3. The method according to any one of claims 1 or 2 wherein said stream of gas is nitrogen.

4. The method according to claim 1 wherein the coating thickness on said one side is controlled by directing jets of fluid against said one side at a location outside said bath where said strip is supported by said deflector roll.

5. The method according to claim 4 wherein said fluid in said jets is a member selected from the group consisting of steam, air, and nitrogen.

6. The method according to any one of claims 4 or 5 wherein said molten coating metal is a member selected from the group consisting of zinc, aluminum, and aluminumzinc.

* * * * *